US011220797B2

(12) United States Patent
Schroeder et al.

(10) Patent No.: US 11,220,797 B2
(45) Date of Patent: Jan. 11, 2022

(54) MOTOR-DRIVEN DISPENSE ARM OF VEHICLE-MOUNTED LINE STRIPER

(71) Applicant: Graco Minnesota Inc., Minneapolis, MN (US)

(72) Inventors: James C. Schroeder, Ramsey, MN (US); Mark D. Shultz, Fridley, MN (US); Roland M. Bedard, Lindstrom, MN (US); Daniel D. Rohling, Corcoran, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 60 days.

(21) Appl. No.: 16/233,633

(22) Filed: Dec. 27, 2018

(65) Prior Publication Data

US 2019/0203432 A1 Jul. 4, 2019

Related U.S. Application Data

(60) Provisional application No. 62/611,632, filed on Dec. 29, 2017.

(51) Int. Cl.
*E01C 23/22* (2006.01)
*E01C 23/16* (2006.01)
(Continued)

(52) U.S. Cl.
CPC ..... *E01C 23/166* (2013.01); *A63C 19/065* (2013.01); *E01C 23/20* (2013.01); *E01C 23/22* (2013.01); *A63C 2019/067* (2013.01)

(58) Field of Classification Search
CPC ..... E01C 23/16; E01C 23/166; E01C 23/22; E01C 23/206
(Continued)

(56) References Cited

U.S. PATENT DOCUMENTS 2,026,678 A * 1/1936 Hefner ..... E01C 23/222 118/305
2,044,558 A * 6/1936 Ball ..... E01C 23/225 15/50.1
(Continued)

FOREIGN PATENT DOCUMENTS

CN 1134572 C 1/2004
CN 206800156 U 12/2017
(Continued)

OTHER PUBLICATIONS

Extended European Search Report for EP Application No. 18248148.1, dated Mar. 21, 2019, pp. 11.
(Continued)

*Primary Examiner* — Thomas B Will
*Assistant Examiner* — Katherine J Chu
(74) *Attorney, Agent, or Firm* — Kinney & Lange, P. A.

(57) ABSTRACT

A ground marking apparatus is configured to apply marking material to a ground surface. The ground marking apparatus includes a beam supported by a beam mount and extending along a beam axis. A carriage is disposed on the beam and movable on the beam along the beam axis. A carriage motor operably interfaces with the beam and is configured to move the carriage along the beam. A dispense arm is supported by the carriage and is configured to move relative to the beam as the carriage moves along the beam.

16 Claims, 12 Drawing Sheets

(51) Int. Cl.
*E01C 23/20* (2006.01)
*A63C 19/06* (2006.01)

(58) Field of Classification Search
USPC ..... 239/176
See application file for complete search history.

(56) References Cited

U.S. PATENT DOCUMENTS 3,148,833 A 9/1964 Wilson et al.
3,162,369 A * 12/1964 Mitchell ..... E01C 23/166 239/150
3,469,534 A * 9/1969 Plasser ..... E01B 27/12 104/7.2
3,775,018 A * 11/1973 Barton ..... E01C 19/43 404/93
3,810,709 A * 5/1974 Weaver ..... B06B 1/164 404/93
3,874,806 A * 4/1975 Grist ..... E01C 19/43 404/93
4,256,261 A 3/1981 Gurney
4,667,854 A * 5/1987 McDermott ..... A47K 5/1215 222/101
4,828,177 A * 5/1989 Schuitemaker ..... A01M 7/0035 239/165
4,930,935 A 6/1990 Quenzi et al.
5,368,232 A * 11/1994 Schroeder ..... B05B 9/0403 239/165
5,468,094 A * 11/1995 Vanderpan ..... B24C 3/06 404/75
5,947,385 A * 9/1999 Lanerd ..... E01C 23/22 239/172
5,951,201 A 9/1999 Jones
6,010,079 A 1/2000 Mayfield et al.
6,021,959 A 2/2000 Mayfield, Jr. et al.
6,413,012 B1 7/2002 Jones
6,942,735 B2 * 9/2005 Rich ..... B05B 13/005 118/313
7,108,196 B2 9/2006 Kime
7,118,629 B2 * 10/2006 Davidson ..... B05B 13/005 118/323
7,367,515 B1 * 5/2008 Newman ..... E01C 23/22 222/608
7,977,311 B2 * 7/2011 Egrie ..... A61P 7/06 514/7.7
9,617,700 B2 4/2017 Eckman
9,795,984 B2 * 10/2017 Hoppel ..... B05C 9/12
D818,006 S * 5/2018 Shultz ..... D15/22
10,661,839 B2 * 5/2020 Froemming ..... E05F 15/616
10,814,236 B1 * 10/2020 Dagley ..... A63G 21/14
2009/0263192 A1 10/2009 Onett, III
2012/0219359 A1 8/2012 Baltus
2013/0122186 A1 * 5/2013 Hoppel ..... B05B 13/041 427/8
2014/0205744 A1 * 7/2014 McNutt ..... E01C 23/22 427/8
2019/0077277 A1 * 3/2019 Holzleitner ..... B60L 13/03

FOREIGN PATENT DOCUMENTS

EP 0807714 A1 11/1997
EP 1221507 A2 * 7/2002 ..... E01C 23/22
EP 3196358 A1 7/2017

OTHER PUBLICATIONS

First Chinese Office Action for CN Application No. 2018116273435, dated Sep. 1, 2020, pp. 25.

* cited by examiner

MOTOR-DRIVEN DISPENSE ARM OF VEHICLE-MOUNTED LINE STRIPER

CROSS-REFERENCE TO RELATED APPLICATION(S)

This application claims priority to U.S. Provisional Application No. 62/611,632 filed on Dec. 29, 2017, and entitled "MOTOR-DRIVEN DISPENSE ARM OF VEHICLE-MOUNTED LINE STRIPER," the disclosure of which is hereby incorporated by reference in its entirety.

BACKGROUND

The present disclosure relates generally to vehicle-mounted line striping systems. More specifically, the present disclosure relates to a motor-driven dispense arm for a vehicle-mounted line striping system.

Vehicle-mounted line striping systems are used for painting stripes on roadways, runways, parking lots, and other ground surfaces. Line striping systems typically comprise pushed and/or gas or electric-propelled platforms that dispense materials used to mark ground surfaces. The systems typically include a gas or electric motor for driving a pump. The pump is fed a flowable material, such as paint, from a container and pumps the fluid to spray nozzles mounted to discharge the fluid toward the ground surface. While paint is used herein as an exemplar, it is understood that paint is merely one example and that other solutions (e.g., water, oil, solvents, beads, flowable solids, pellets, etc.) can be applied in addition to or instead of paint. In some cases, ground markings can be thermally applied instead of sprayed as a paint.

Striping systems are typically mounted on a vehicle. For example, the striping systems can be mounted on the bed of a truck. Such a striping system has the advantage of being used in a common truck, such as a pickup truck, without the need of a specialized vehicle. The striping systems can be palletized such that they can be loaded, lifted, placed, and unloaded by a conventional pallet jack or forklift in the same manner as a conventional pallet. When mounted on a vehicle, one or more dispense outlets are mounted on an extension that extends away from the vehicle to dispense the striping material as the vehicle drives. In most cases, the extension is on the lateral side of the vehicle to apply one or more stripes to the side of the vehicle as the vehicle drives forward. Such a system can apply a large volume of striping material to the ground due to the carrying capacity of the vehicle, both in terms of material to be applied and the pumping, mixing, and dispensing equipment, and due to the distance that such a vehicle can efficiently cover, particularly along a long stretch of roadway.

The large volume of striping facilitated by the use of a vehicle can also make accurate stripe placement difficult. The location of the dispense outlet, and thus of the stripes being marked, depends on the position of the vehicle as it moves forward, typically based on the driver's conventional input to the steering wheel. However, typical vehicles are not intended to provide the precision required during the dispense process. In addition, the driver is not in a desirable position, facing forward, to view the exact placement of the stripes, which is occurring behind the driver and possibly on the opposite side of the vehicle from the driver. What is needed is a system and methods to address the accuracy issues experienced by a vehicle-mounted striping system.

SUMMARY

According to one aspect of the disclosure, a ground marking apparatus includes a beam mount, a beam supported by the beam mount and extending along a beam axis, a carriage disposed on the beam and movable on the beam along the beam axis, a carriage motor operably interfacing with the beam and configured to move the carriage along the beam; and a dispense arm supported by the carriage.

According to another aspect of the disclosure, a striping system for applying a marking material to a ground surface includes a fluid reservoir configured to store marking material, a support frame configured to be mounted on a vehicle, a beam mount connected to the support frame, a beam supported by the beam mount and extending along a beam axis, a carriage disposed on the beam and movable on the beam along the beam axis, a carriage motor operably interfacing with the beam and configured to move the carriage along the beam, a dispense arm supported by the carriage, the dispense arm including dispense outlets configured to eject marking material onto a ground surface, a pumping module supported by the support frame and configured to pump marking material from the fluid reservoir to the dispense outlets.

According to yet another aspect of the disclosure, a method includes providing a first input to a carriage motor to cause the carriage motor to drive rotation of a roller in a first rotational direction, wherein the roller interfaces with a beam; driving a carriage along the beam in a first lateral direction by the rotation of the roller in the first rotational direction, wherein the carriage motor is supported by and moves along the beam with the carriage; displacing a dispense arm in the first lateral direction by a connection between the carriage and the dispense arm; providing a second input to the carriage motor to cause the carriage motor to drive rotation of the roller in a second rotational direction; and driving the carriage along the beam in a second lateral direction by the rotation of the roller in the second rotational direction, wherein displacing the carriage also displaces the dispense arm in the second lateral direction.

DETAILED DESCRIPTION

Figure 1A:
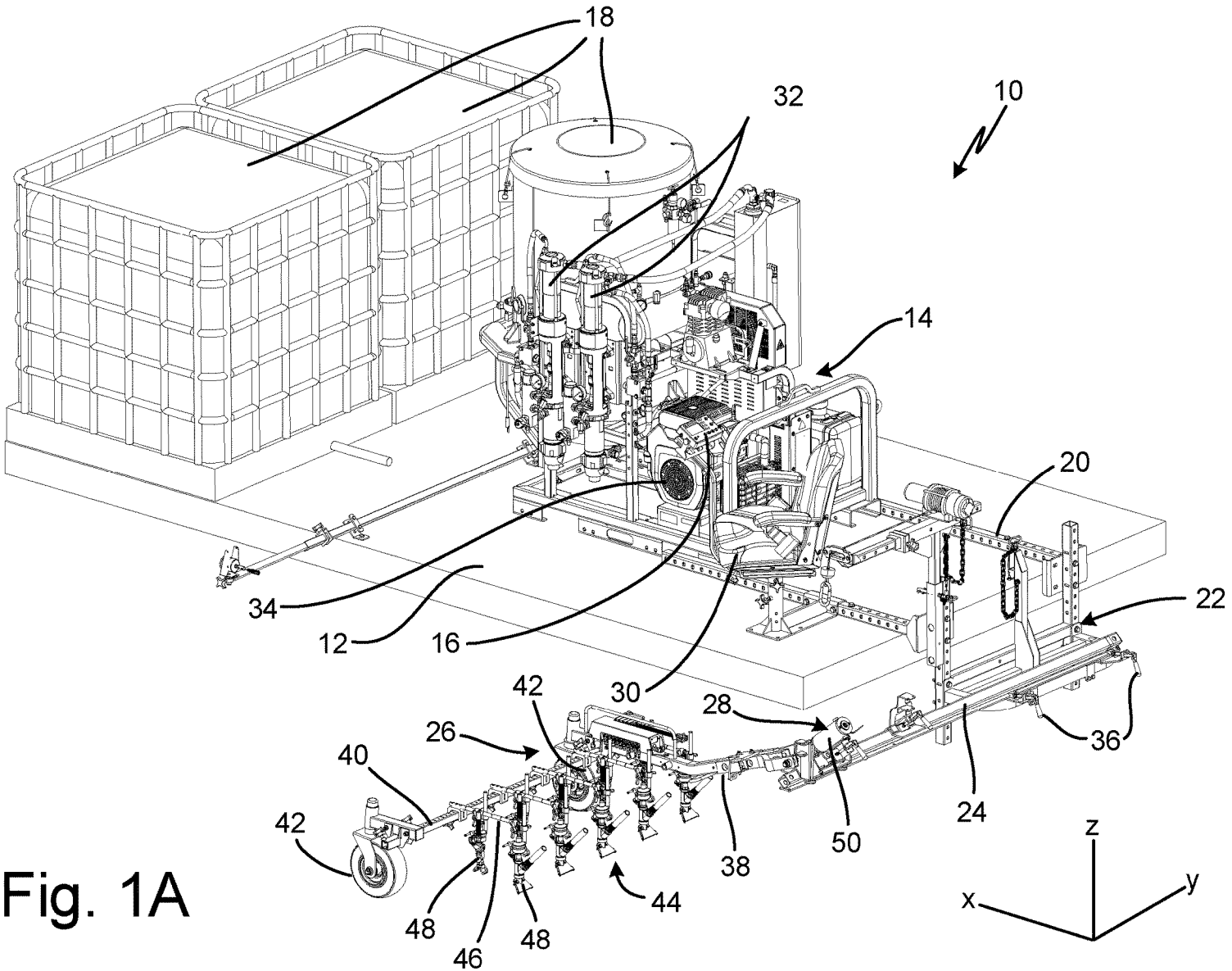
FIG. 1A is an isometric view of a striping system.
Figure 1B:
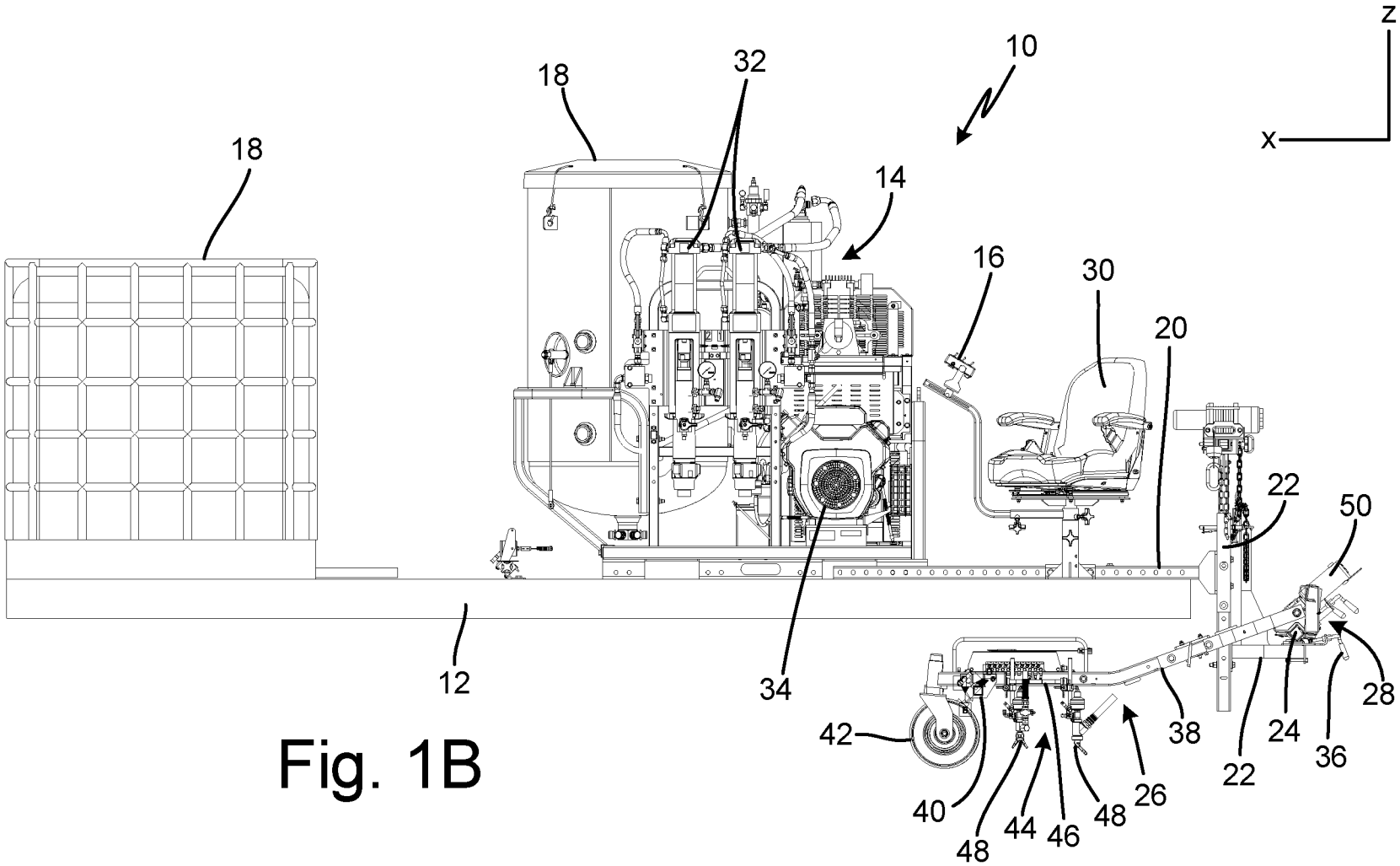
FIG. 1B is a side elevation view of a striping system.
Figure 1C:
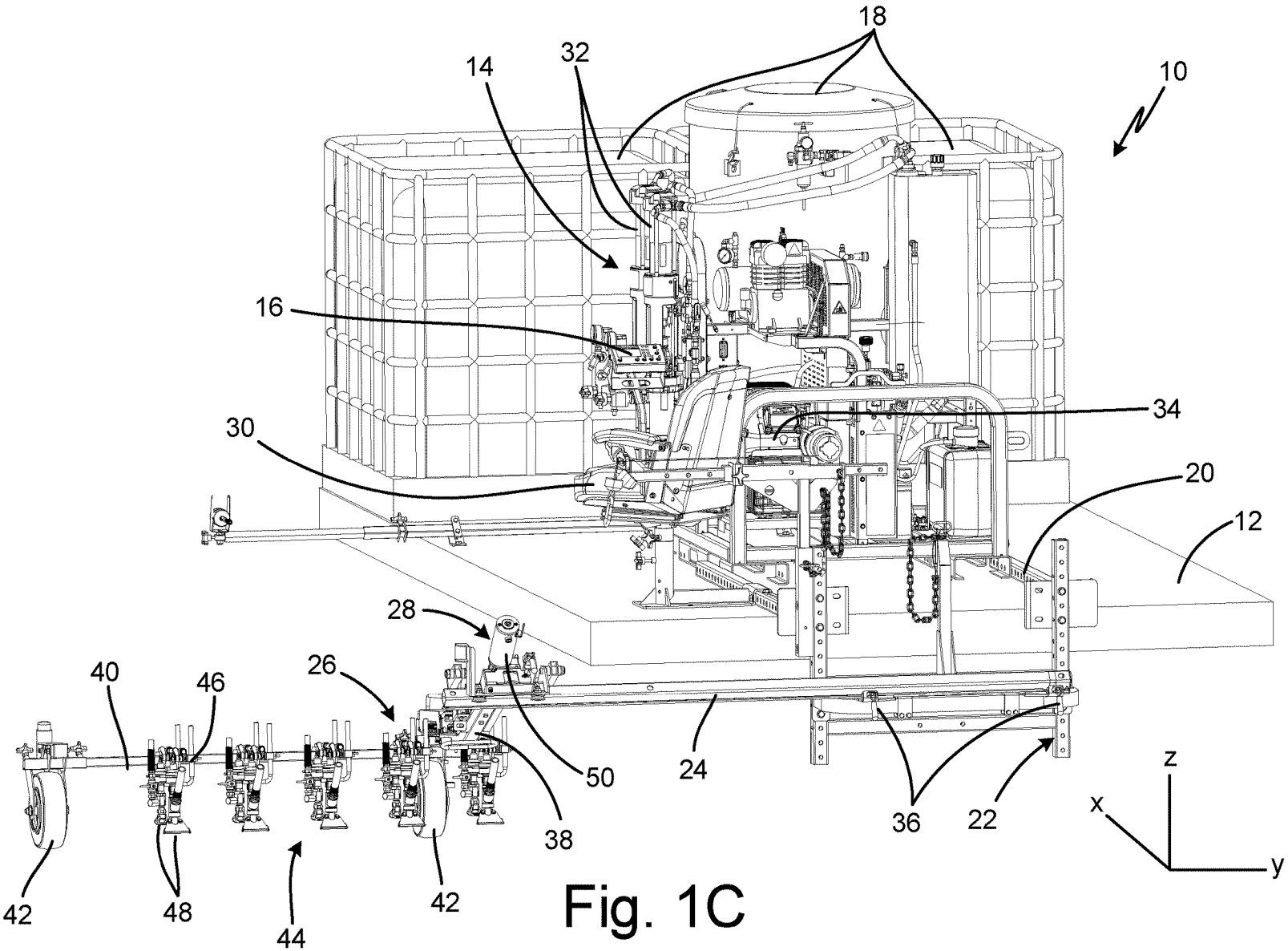
FIG. 1C is a rear elevation view of a striping system.

FIG. 1A is an isometric view of striping system 10. FIG. 1B is a side elevation view of striping system 10. FIG. 1C is a rear elevation view of striping system 10. FIGS. 1A-1C will be discussed together. Striping system 10 includes vehicle surface 12, pumping module 14, user interface 16, fluid reservoirs 18, support frame 20, beam mount 22, beam 24, dispense arm 26, carriage 28, and seat 30. Pumping module 14 includes pumps 32 and motor 34. Beam mount 22 includes beam clamps 36. Dispense arm 26 includes boom 38, lateral arm 40, wheels 42, and dispensing modules 44. Dispensing modules 44 includes gun arms 46 and dispense outlets 48. Carriage 28 includes carriage motor 50.

Striping system 10 is a system for applying stripes of a marking material, such as paint, water, oil, solvents, beads, reflective glass beads, flowable solids, pellets, etc., to a ground surface, such as a roadway, runway, parking lot, or other desired surface. While the term "stripes" is used herein as an example, it will be understood that the scope of this disclosure includes dispensing fluid and/or material on any surface in any pattern, and is not limited to the marking of stripes. As used herein, "front" or "forward" means in the direction of fluid reservoirs 18 (or toward a cab of the vehicle) along the X-axis while "back" or "rear" means in the opposite direction, towards beam 24 along the X-axis. "Up" and "down" means an orientation along the Z-axis. "Vertical" also means an orientation along the Z-axis in either the up direction or down direction. "Left" or "driver's side" means in the direction toward the position of carriage 28 shown in FIG. 1A from the vehicle along the Y-axis, while "right" or "passenger's side" means the opposite direction, toward the position of carriage 28 shown in FIG. 9 from the vehicle along the Y-axis. "Lateral" also means an orientation along the Y-axis in either the left or driver's side direction, or the right or passenger's side direction.

Vehicle surface 12 is a surface of a self-propelled vehicle that supports other components of striping system 10. For example, vehicle surface 12 can be the bed of a truck, such as a pickup truck, a pallet or other structure mounted to a truck, or another vehicle surface. Fluid reservoirs 18 are disposed on vehicle surface 12 and are configured to store the material prior to application to the ground surface. The material can be any desired material suitable for creating the stripes, such as paint, flowable solids such as beads, plural component materials, or any other suitable material. In the case of beads, system 10 can include a compressor for pressurizing fluid reservoirs 18 and generating an airflow to carry the beads out of fluid reservoirs 18.

Support frame 20 is disposed on vehicle surface 12 and supports various components of striping system 10. Support frame 20 is configured to mount to vehicle surface 12 and can either rest on vehicle surface 12 or be connected to vehicle surface 12. In some examples, support frame 20 is removably connected to vehicle surface 12, such as by fasteners, such as bolts, or straps. In other examples, support frame 20 is permanently connected to vehicle surface 12, such as by welding.

Pumping module 14 is supported by support frame 20 and configured to drive the marking material from fluid reservoirs 18 to dispense arm 26. Pumps 32 are supported by support frame 20 and are fluidly connected to fluid reservoirs 18. Motor 34 is also supported by support frame 20 and is configured to power pumps 32. In some examples, motor 34 can also power an air compressor to power pumps 32, where pumps 32 are pneumatic, or to pressurize one fluid reservoir 18 to drive reflective glass beads to and out of glass bead dispensers. It is understood, however, that pumps 32 can be driven in any desired manner, such as mechanically, electrically, or hydraulically, and motor 34 can be of any suitable configuration for powering pumps 32. While pumping module 14 is shown as including two pumps 32, it is understood that pumping module 14 can include fewer or greater number of pumps 32. Moreover, pumping module 14 can include any desired configuration of pump 32 suitable for driving the marking material from fluid reservoirs 18 to dispense module 44, such as piston pumps, diaphragm pumps, georotor pumps, lobe pumps, rotary vane pumps, peristaltic pumps, and plunger pumps, among other options.

Seat 30 is supported by support frame 20. A user is typically seated in seat 30 during operation. The position of seat 30 allows the user to monitor the placement of the stripe by striping system 10 and adjust the location of dispense arm 26 as needed. User interface 16 extends from seat 30 and provides controls to the user to allow the user to actuate carriage 28 and adjust the position of dispense arm 26 along the Y-axis. User interface 16 is operatively connected to carriage motor 50 to control operation of carriage motor 50.

Beam mount 22 extends from support frame 20. Beam mount 22 is directly or indirectly connected to support frame 20, such as by bolts or intermediate structural plates and/or tubes. Beam 24 is mounted on beam mount 22 and is secured to beam mount 22 by beam clamps 36. Beam clamps 36 prevent movement of beam 24 relative to beam mount 22 and support frame 20. Beam 24 is cantilevered from beam mount 22 with a free end of beam 24 spaced from vehicle surface 12. Beam 24 extends laterally along the Y-axis from vehicle surface 12 so that the free end of beam 24 is positioned to the left side of vehicle surface 12 and the remainder of the vehicle.

Carriage 28 rides on beam 24. Carriage 28 is movable along the entire length of beam 24. Specifically, carriage 28 can move laterally along the Y-axis. Carriage motor 50 is configured to drive carriage 28 laterally along beam 24 on the Y-axis.

Dispense arm 26 is connected to beam 24 by carriage 28. Boom 38 is attached to and extends from carriage 28. Lateral arm 40 extends laterally from boom 38 along the Y-axis. Wheels 42 are disposed at the ends of boom 38 and are configured to support dispense arm 26 relative to the ground. Wheels 42 support the weight of dispense arm 26 on the ground surface. Wheels 42 are preferably caster wheels that can rotate both about the Z-axis and an axis perpendicular to the Z-axis, such that dispense arm 26 can be moved in any desired direction along the X-Y plane. Wheels 42 typically bracket the ground surface being marked by striping system 10. While dispense arm 26 is shown as including two wheels 42, it is understood that dispense arm 26 can include any desired number of wheels 42 to support dispense arm 26 on the ground surface, such as one, three, four, or any other desired number of wheels 42. Lateral translation of carriage 28 along beam 24 likewise causes lateral movement of dispense arm 26.

Gun arms 46 extend from boom 38 and dispensing modules 44 are disposed on gun arms 46. Dispensing modules 44 are fluidly connected to pumps 32 to receive marking material from pumps 32 and apply the marking material to the ground surface. Gun arms 46 are disposed generally orthogonal to lateral arm 40. While dispense arm 26 is shown as including five gun arms 46, it is understood that dispense arm 26 can include as many or as few gun arms 46 as desired, such as one, two, three, or any desired number. Dispense outlets 48 are typically positioned above the surface being marked by one or more inches. Dispense outlets 48 eject the marking material onto the ground surface. Dispense outlets 48 are moved along the surface being marked by forward motion of the vehicle, which motion is translated to dispense outlets 48 by support frame 20, beam mount 22, beam 24, carriage 28, and dispense arm 26. In some examples, dispense outlets 48 are positioned relative to one another so as to eliminate any gaps between the stripes generated by dispense outlets 48. Two variations of dispense outlet 48 are shown, spray nozzles and bead dispensers, but it is understood that dispense arm 26 can include as few or as many varieties of dispense outlets 48 as desired. Moreover, dispense arm 26 can include additional variations of dispense outlets 48 in addition to spray nozzles and bead dispensers.

During operation, the vehicle that vehicle surface 12 is a part of is driven across the ground surface in the longitudinal direction, along the X-axis. A user separate from the driver is seated in seat 30 and controls the position of dispense arm 26 along the Y-axis via user interface 16. As such, the user can monitor the application of the stripes and the lateral position of dispense arm 26 independent from steering of the vehicle. Pumps 32 draw the marking material from fluid reservoirs 18 and drive the marking material to dispensing modules 44. Dispense outlets 48 eject the marking material onto the ground surface.

As the vehicle travels in the longitudinal direction, the user controls the position of dispense arm 26 on beam 24 along the Y-axis to ensure that dispensing modules 44 are applying stripes of material in a consistent, even manner. Carriage motor 50 is operatively connected to beam 24 by a roller wheel, discussed in further detail below. The user controls actuation of carriage motor 50 via user interface 16 to cause carriage 28 to move laterally along the length of beam 24. The carriage 28 can move towards the vehicle or away from the vehicle along beam 24.

To control the position of carriage 28, user interface 16 can include a dial, switch, or other input (not shown) that can be actuated by the user watching the lateral position of dispense outlets 48. A neutral position of the dial, switch, or other input can correspond to no power signal being supplied to the carriage motor 50. A first type of actuation of the dial, switch, or other input can cause a control circuit (not shown) to supply direct current electrical power to the carriage motor 50 to cause carriage motor 50 to drive dispense arm 26 in a first direction along beam 24, such as away from vehicle surface 12. A second type of actuation of the dial, switch, or other input can supply direct current electrical power, having an opposite polarity, to carriage motor 50 to drive dispense arm 26 in a second, opposite direction along beam 24, such as toward vehicle surface 12. The amount of voltage or current supplied to the carriage motor 50 can be proportionate with the degree of actuation of the dial, switch, or other input from neutral, such that actuating the dial, switch, or other input further from neutral supplies greater current or voltage (e.g., of either polarity) to carriage motor 50 to cause faster rotational output of carriage motor 50, and thus faster lateral movement of carriage 28 along beam 24, as compared to lesser deviation from neutral.

Carriage motor 50 driving carriage 28 along beam 24 provides significant advantages. The user can control actuation of carriage motor 50 via user interface 16. As such, the user can dynamically adjust the lateral position of dispense arm 26 relative to vehicle while the vehicle is in motion. This increases the efficiency of the application process, as the vehicle does not have to stop to allow the user to adjust the position of dispense arm 26. Moreover, striping system 10 applies more consistent lines, particularly around curves, as the user is able to actively adjust the position dispense arm 26 along the Y-axis while the vehicle is in motion.

Figure 2:
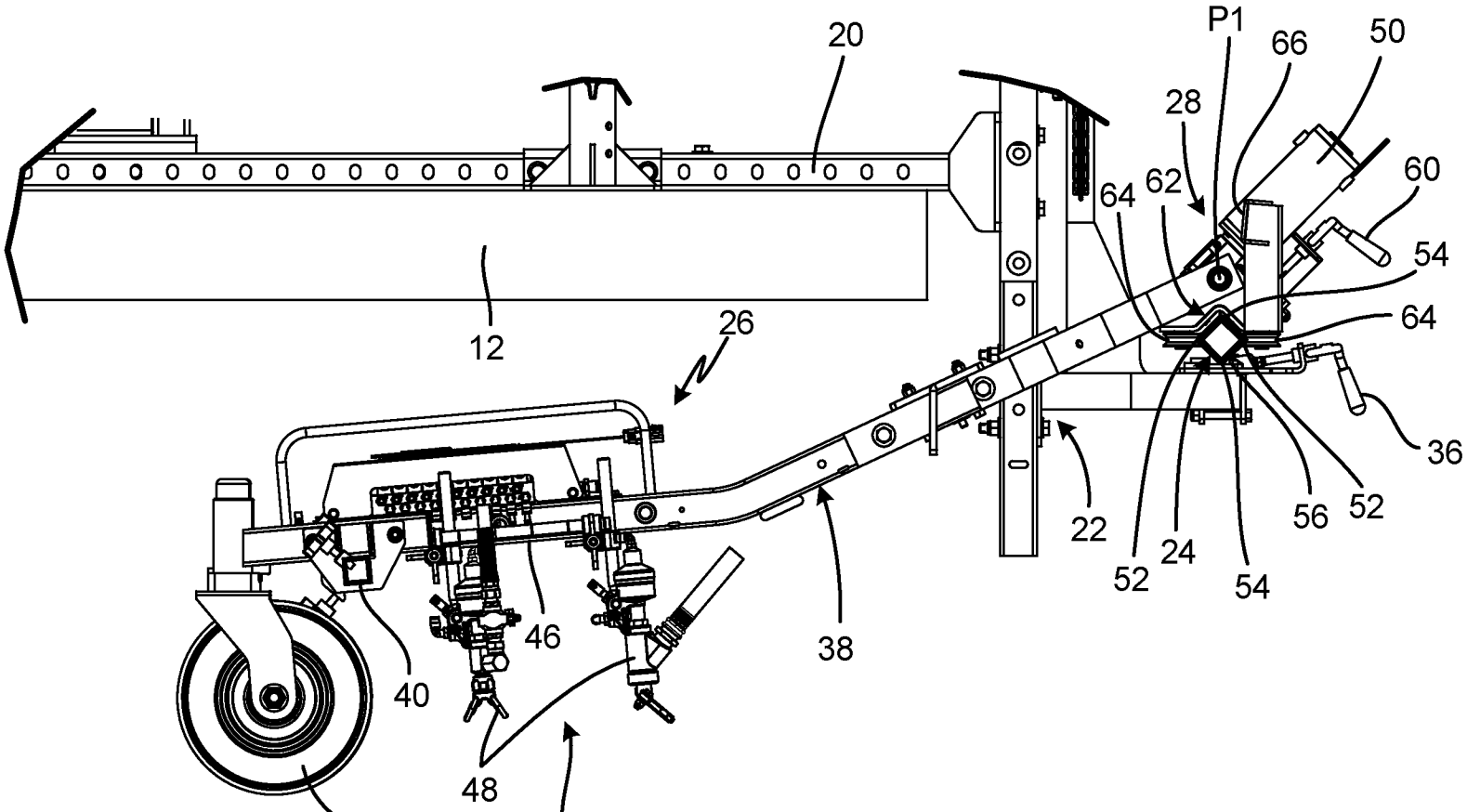
FIG. 2 is a detail side elevation view of a dispense arm of a striping system.

FIG. 2 is a side elevation view showing vehicle surface 12, support frame 20, beam mount 22, beam 24, dispense arm 26, carriage 28, and beam clamp 36. Beam 24 includes horizontal corners 52, vertical corners 54, and beam flange 56. Dispense arm 26 includes boom 38, lateral arm 40, wheels 42, and dispensing modules 44. Boom 38 includes fork 58. Dispensing modules 44 each include gun arm 46 and dispense outlets 48. Carriage 28 includes carriage motor 50, carriage clamp 60, carriage bracket 62, guide wheels 64, and stop 66.

Beam 24 extends laterally along the Y-axis (shown in FIGS. 1A-1C). Beam mount 22 connects beam 24 to support frame 20. Beam 24 is secured to beam mount 22 by beam clamp 36. As shown, beam clamp 36 engages beam flange 56 to secure beam 24 to beam mount 22. Beam flange 56 extends along the length of beam 24 and is attached to beam 24 are the bottom most vertical corner 54. Support frame 20 is supported on vehicle surface 12. Carriage 28 is mounted on beam 24 and is configured to shift laterally along beam 24 to control the lateral position of dispense arm 26. As shown, beam 24 is a square beam oriented such that the points of beam 24 are disposed vertically and horizontally. Horizontal corners 52 of beam 24 are disposed horizontally along the X-axis. Vertical corners 54 of beam 24 are disposed vertically along the Z-axis.

Carriage 28 is disposed on beam 24 and configured to move laterally along beam 24. Carriage bracket 62 is disposed on beam 24. Carriage motor 50 is supported by carriage bracket 62. Carriage motor 50 is connected to a wheel, such as roller 68 (best seen in FIGS. 3B-4B), that is configured to drive carriage 28 along beam 24. Roller 68 interfaces with beam 24 to facilitate the driving of carriage 28. Roller 68 can interface with beam 24 in any desired manner, such as by interlocking grooves where beam 24 is a rack and roller 68 is a pinion, or by friction between roller 68 and beam 24.

Carriage motor 50 is configured to drive the rotation of roller 68, which causes carriage 28 to traverse along beam 24. Guide wheels 64 are mounted on carriage bracket 62 and are configured to bracket beam 24. Guide wheels 64 are flanged wheels that run along beam 24. Horizontal corners 52 are received between the flanges of guide wheels 64. Guide wheels 64 roll along horizontal corners 52 as dispense arm 26 moves along beam 24. As such, horizontal corners 52 are the track along which guide wheels 64 roll. Guide wheels 64 bracket beam 24 and prevent carriage 28 from rotating about beam 24. Carriage 28 is positioned on beam 24 such that carriage 28 can pass over beam clamps 36 as carriage 28 moves along beam 24.

Carriage clamp 60 can shift between a locked position, where carriage 28 is operably secured on beam 24, and an unlocked position, where carriage is operably detached from beam 24. In the locked position, roller 68 engages beam 24 and prevents carriage 28 from shifting along beam 24 except for movement caused by roller 68. In the unlocked position, roller 68 is disengaged from beam 24 and carriage 28 can freely move along beam 24, independent of carriage motor 50 and roller 68.

Boom 38 extends from carriage 28. Fork 58 is connected to carriage 28 at pivot point P1. During transport, dispense arm 26 is rotated upwards around the Y-axis so boom 38 extends substantially vertically, along the Z-axis. In the upward position, boom 38 rests against stop 66. Lateral arm 40 extends laterally from boom 38 along the Y-axis. Wheels 42 are disposed at the ends of boom 38 and are configured to support dispense arm 26 relative to the ground. Gun arms 46 extend from boom 38 and dispensing modules 44 are disposed on gun arms 46. Dispensing modules 44 are fluidly connected to pumps 32 to receive marking material from pumps 32, and dispensing modules 44 apply the marking material to the ground surface. Gun arms 46 are disposed generally orthogonal to lateral arm 40.

During operation, the user activates carriage motor 50 to cause carriage motor 50 to drives carriage 28 laterally along beam 24. Carriage motor 50 drives the rotation of roller 68, which interfaces with beam 24 and causes the movement of carriage 28 along beam 24. The user can adjust the lateral position of dispense arm 26 along the Y-axis simply by activating carriage motor 50.

Figure 3A:
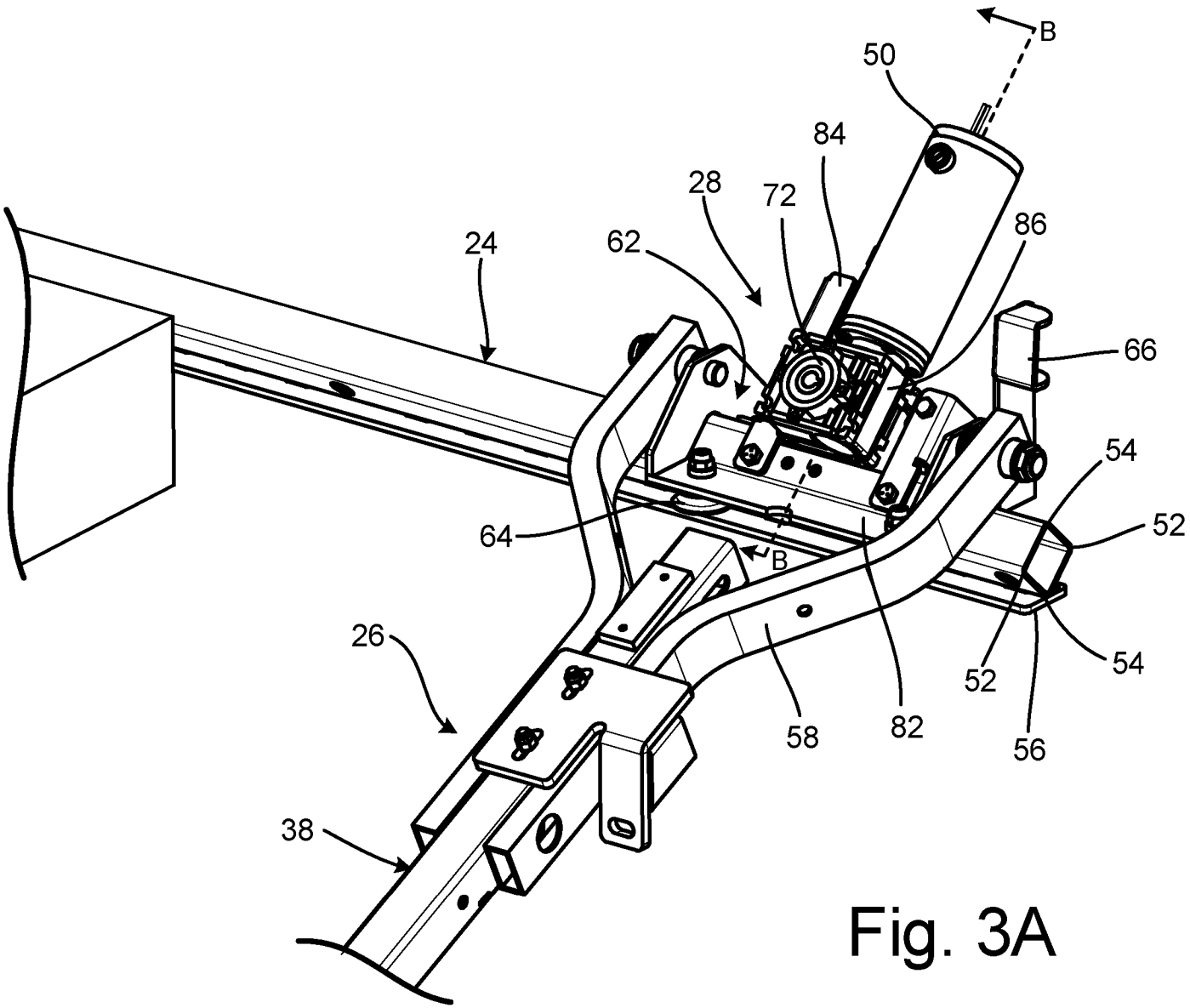
FIG. 3A is an isometric view of a carriage.
Figure 3B:
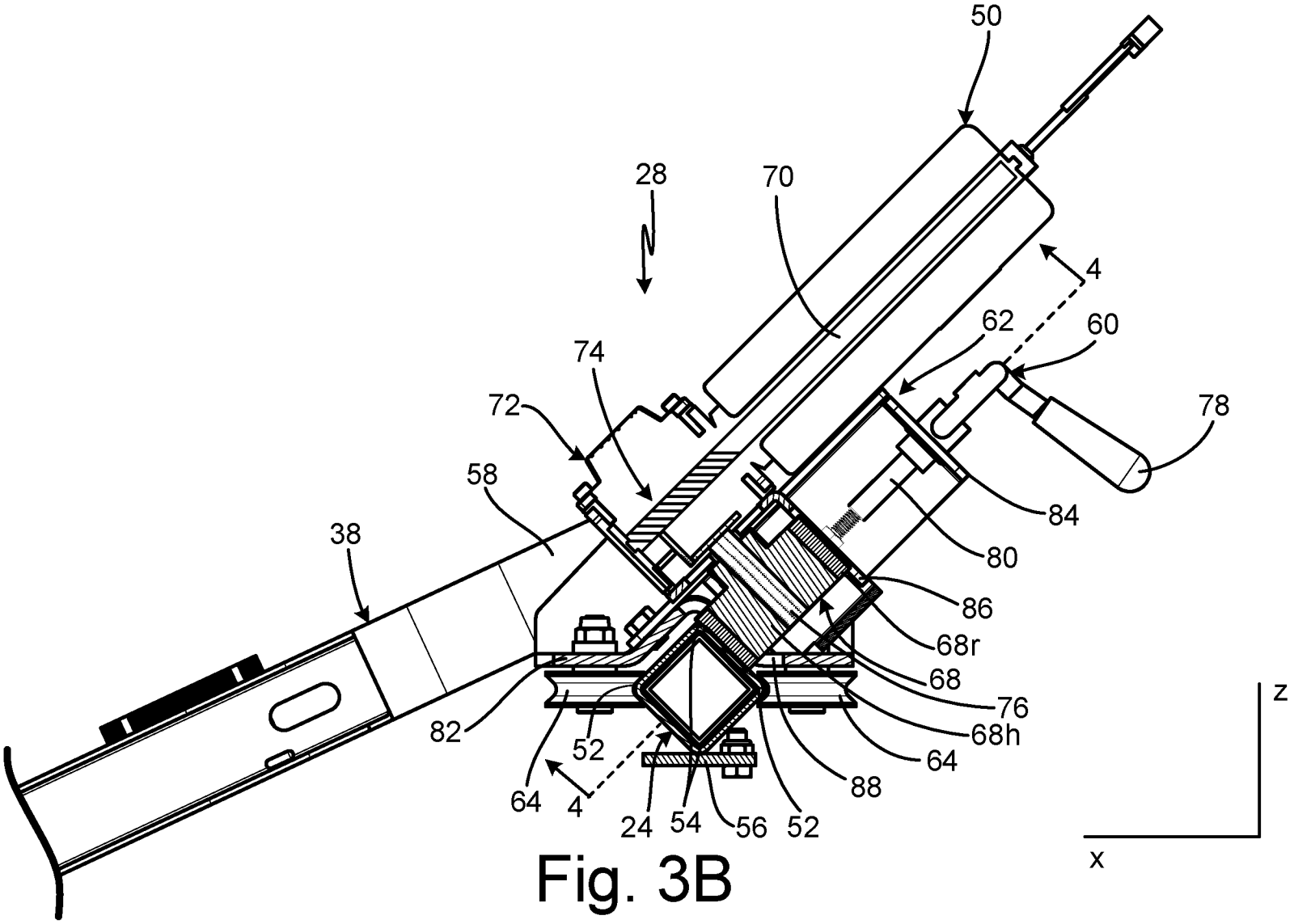
FIG. 3B is a cross-sectional view taken along line B-B in FIG. 3A.

FIG. 3A is an isometric view of carriage 28. FIG. 3B is a cross-sectional view of carriage 28 taken along line B-B in FIG. 3A. FIGS. 3A and 3B will be discussed together. Beam 24 and dispense arm 26 of striping system 10 (best seen in FIGS. 1A-1C) are shown. Boom 38 of dispense arm 26 is shown, and fork 58 of boom 38 is shown. Carriage 28 includes carriage motor 50, carriage clamp 60 (FIG. 3B), carriage bracket 62, guide wheels 64, stop 66 (FIG. 3A), and roller 68 (FIG. 3B). Carriage motor 50 includes drive shaft 70 (FIG. 3B) and gearbox 72. Gearbox 72 includes gearing 74 (FIG. 3B) and output shaft 76 (FIG. 3B). Carriage clamp 60 includes lever 78 (FIG. 3B) and clamp shaft 80 (FIG. 3B). Carriage bracket 62 includes transverse plate 82, clamp bracket 84, and motor bracket 86. Transverse plate 82 includes roller opening 88 (FIG. 3B). Beam 24 includes horizontal corners 52, vertical corners 54, and beam flange 56.

Carriage 28 supports dispense arm 26 on beam 24. Transverse plate 82 is disposed on beam 24. Fork 58 is attached to boom 38 and connects boom 38 to transverse plate 82. Fork 58 can be attached to transverse plate 82 in any desired manner, such as by threaded studs and nylon locking nuts. In one example, the threaded studs can be integral with transverse plate 82. Fork 58 is configured to pivot relative to transverse plate 82, which allows dispense arm 26 to be rotated to an upright, stowed position (shown in FIG. 8) for transport, storage, or moving dispense arm 26 to the other side of the vehicle. While in the upright position, one arm of fork 58 rests against stop 66.

Guide wheels 64 are mounted on transverse plate 82 and bracket horizontal corners 52 of beam 24. Guide wheels 64 are flanged wheels that receive horizontal corners 52 between their respective flanges. Guide wheels 64 are freely rotatable about their individual axes and run along horizontal corners 52 as carriage 28 moves laterally along beam 24. Guide wheels 64 help maintain carriage 28 in an upright position, preventing transverse plate 82 from rotating about beam 24, particularly with roller 68 in the disengaged position. Guide wheels 64 also space transverse plate 82 from beam 24. Spacing transverse plate 82 from beam 24 allows carriage 28 to glide along beam 24 when roller 68 is disengaged from beam 24, thereby simplifying the process of shifting dispense arm 26 from one side of the vehicle to an opposite side of the vehicle, as discussed in more detail with regard to FIG. 9.

Clamp bracket 84 is mounted on transverse plate 82 in any desired manner. In one example, clamp bracket 84 can be attached to transverse plate 82 by bolts or other suitable fasteners. In another example, clamp bracket 84 is permanently attached to transverse plate 82, such as by welding. Carriage clamp 60 is mounted on clamp bracket 84. Clamp lever 78 controls clamp shaft 80 between the locked state and the unlocked state. Clamp shaft 80 extends from clamp lever 78 to motor bracket 86.

Motor bracket 86 is pivotally attached to clamp bracket 84. Carriage motor 50 is mounted on motor bracket 86. In the example shown, carriage motor 50 is an electric direct current motor having an armature and a stator, but it is understood that any motor suitable for causing both clockwise and counterclockwise rotation of roller 68 can be used.

As shown in FIG. 3B, drive shaft 70 of carriage motor 50 extends into gearbox 72 and interfaces with gearing 74 in gearbox 72. Gearing 74 is configured to receive rotational input from drive shaft 70 and drive rotation of output shaft 76. Gearing 74 is reduction gearing configured to provide a low-speed high-torque output while receiving a high-speed low-torque input from carriage motor 50. Gearing 74 allows a smaller electric motor to be mounted on carriage 28 and drive roller 68. In one example, carriage motor 50 can rotate drive shaft 70 at up to about 3000 revolutions per minute (rpm), while gearing 74 causes output shaft 76 to rotate at about 24 rpm. It is understood however, that gearbox 72 can provide any desired reduction ratio between the carriage motor 50 and roller 68.

It is understood that gearing 74 can include any desired gear mechanism for reducing the speed of the rotational output from drive shaft 70 to output shaft 76. In the example shown, drive shaft 70 includes a worm and gearing 74 includes worm wheels. A worm gear configuration provides significant advantages. Worm gearing prevents force feedback to carriage motor 50 due to vibrations or other sources. Due to gearing 74 locking roller 68, when dispense arm 26 bumps into an obstacle, such as a curb or pothole, the ensuing jolt does not cause carriage 28 to change positions relative to beam 24. Worm gearing thereby operationally locks carriage 28 in a desired position on beam 24, as the large frictional forces between the worm gears and the worm prevent forces being transmitted to gearing 74 from causing rotation of drive shaft 70. As such, roller 68 cannot shift along beam 24 unless actively powered by carriage motor 50.

Roller 68 is mounted on output shaft 76. Roller 68 extends through roller opening 88 in transverse plate 82 and interfaces with beam 24. Roller 68 is configured to cause lateral movement of carriage 28 along beam 24. In some examples, roller 68 is made from an elastomer, such as neoprene rubber, a polyurethane, or other elastomer, and roller 68 is driven along beam 24 due to the friction between roller 68 and beam 24. In one example, roller 68 includes a metallic hub 68*h* and an elastomer rim 68*r*. Roller 68 being a pliable material, such as rubber, a polyurethane, or other elastomer, provides significant advantages. Roller 68 can be connected to beam 24 at any desired location along beam 24, without regard to the location of any interface features, such as grooves. Moreover, the load holding roller 68 on beam 24 can be adjusted via carriage clamp 60. As roller 68 experiences compression set and wear over its lifespan, the preload can be increased to facilitate the frictional interface between roller 68 and beam 24. As such, roller 68 has a longer useful life in examples where roller 68 is made at least partially of rubber. In other examples, roller 68 and beam 24 can be arranged as a rack and pinon, where roller 68 is the pinion and beam 24 is the rack. As such, each of roller 68 and beam 24 can include interlocking teeth.

During operation, the user provides a signal to carriage motor 50 to activate carriage motor 50. Carriage motor 50 can cause drive shaft 70 to rotate in either the clockwise or counterclockwise direction. Carriage motor 50 can thereby cause roller 68 to rotate in either the clockwise or counterclockwise direction to drive carriage 28 in laterally in either the left or right direction along the Y-axis. When activated, drive shaft 70 rotates and drives the rotation of gearing 74. Gearing 74 drives the rotation of output shaft 76, and output shaft 76 drives the rotation of roller 68. Rotation of roller 68 creates a translational force via frictional interface between circumferential edge of roller 68 and the flat face of beam 24. Being that beam 24 is anchored by beam clamps 36

(FIGS. 1A-1C), beam 24 does not move due to the translational force. Instead, rotation of roller 68 causes carriage 28 to shift laterally along beam 24.

Guide wheels 64 ride on horizontal corners 52 as carriage 28 translates along beam 24. Guide wheels 64 space transverse plate 82 from beam 24, thereby facilitating smooth movement of carriage 28 along beam 24. Guide wheels 64 also prevent carriage 28 from rotating about beam 24. As carriage 28 moves laterally along beam 24, dispense arm 26 also moves laterally along beam 24 due to the connection of fork 58 and transverse plate 82. The user can remotely adjust the lateral position of dispense arm 26 by activating carriage motor 50. Carriage motor 50 can also be activated during operation, providing dynamic control over the position of dispense arm 26. The user adjusting the position of dispense arm 26 without stopping the striping process reduces downtime and increases efficiency.

Carriage motor 50 can rotate drive shaft 70 in either clockwise or counterclockwise directions, depending on the polarity or other parameter of the power signal provided to carriage motor 50. As such, the user can dynamically control the position of carriage 28, and thus of dispense arm 26, in either lateral direction along beam 24.

Figure 4A:
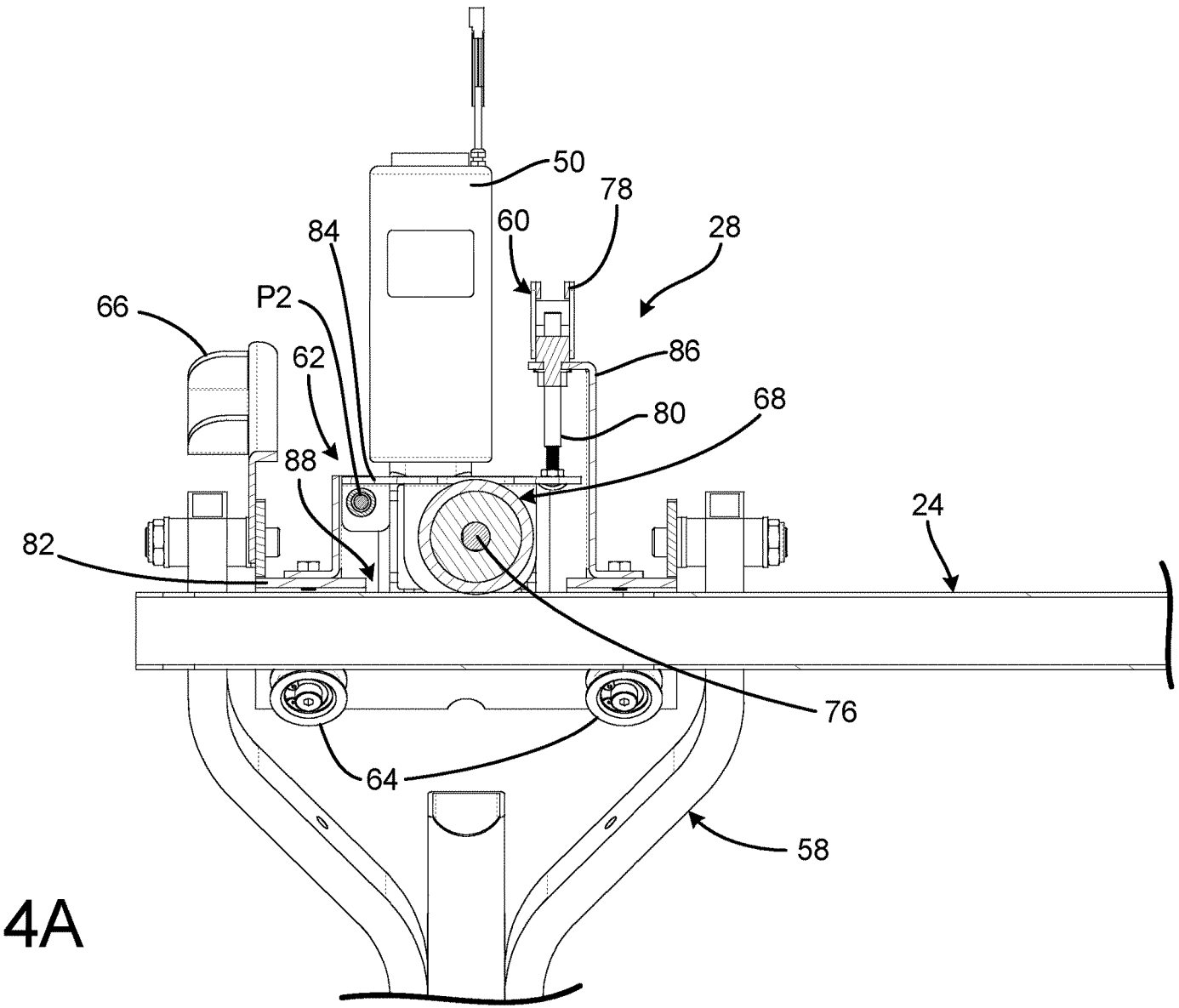
FIG. 4A is a cross-sectional view taken along line 4-4 in FIG. 3B showing a carriage in an engaged position.
Figure 4B:
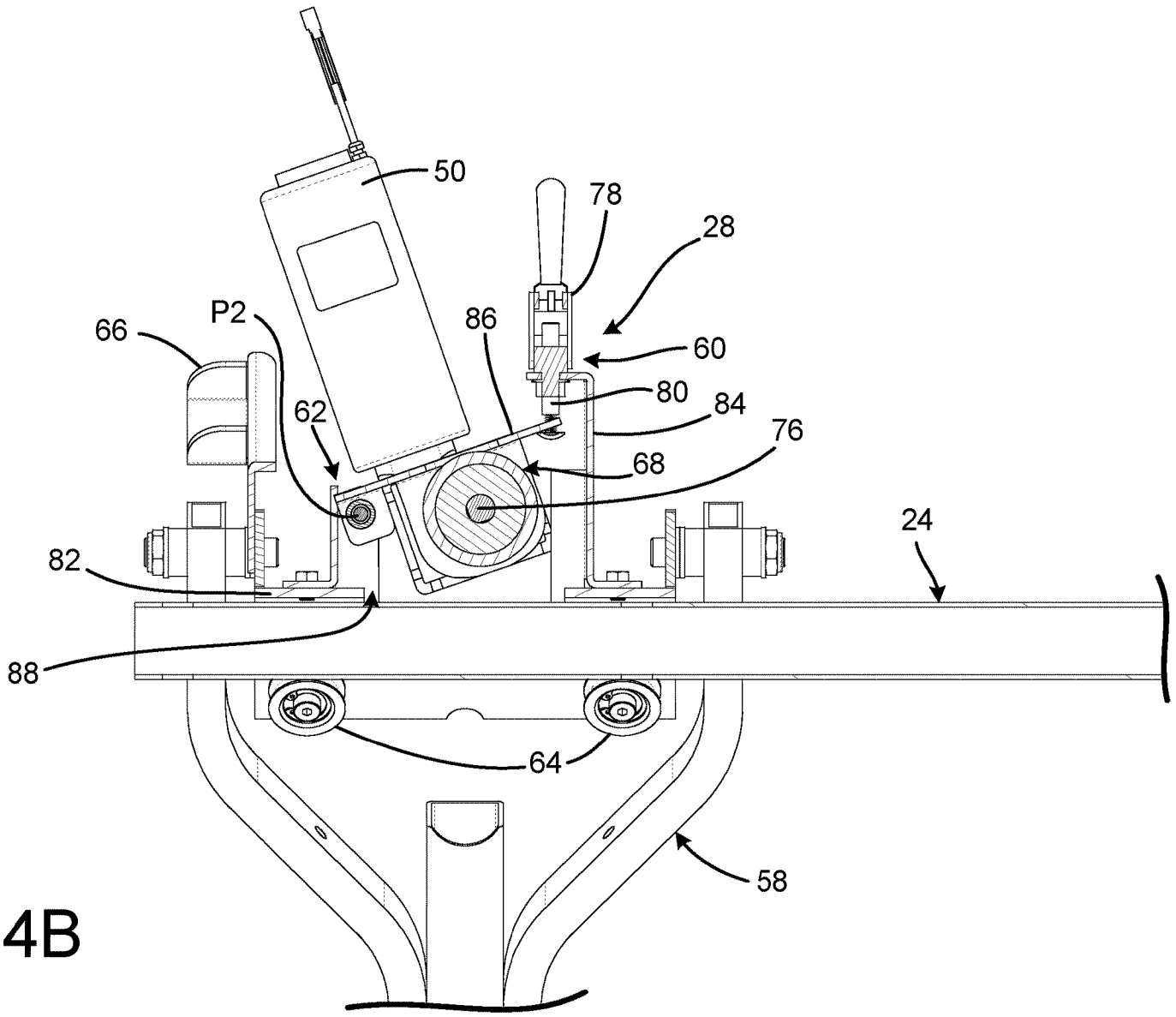
FIG. 4B is a cross-sectional view showing a carriage in a disengaged position.

FIG. 4A is a cross-sectional view of carriage 28 with roller 68 in an engaged state. FIG. 4B is a cross-sectional view carriage 28 with roller 68 in a disengaged state. Beam 24 of striping system 10 (FIGS. 1A-1C) is shown. Fork 58 of dispense arm 26 (best seen in FIGS. 1A-2) is shown. Carriage motor 50, carriage clamp 60, carriage bracket 62, guide wheels 64, stop 66, and roller 68 of carriage 28 are shown. Output shaft 76 of carriage motor 50 is shown. Carriage clamp 60 includes lever 78 and clamp shaft 80. Carriage bracket 62 includes transverse plate 82, clamp bracket 84, and motor bracket 86. Transverse plate 82 includes roller opening 88.

Transverse plate 82 extends across beam 24. Guide wheels 64 are attached to transverse plate 82 and are configured to bracket beam 24. Clamp bracket 84 is mounted on and extends from transverse plate 82. Motor bracket 86 is attached to clamp bracket 84 at pivot point P2. Fork 58 is mounted to and extends from transverse plate 82.

Carriage clamp 60 is supported by clamp bracket 84 and is configured to control motor bracket 86 between the engaged position shown in FIG. 4A and the disengaged position shown in FIG. 4B. In the example shown, carriage clamp 60 is an overcenter clamp that toggles between two locked positions corresponding to the engaged state and the disengaged state. It is understood, however, that carriage clamp 60 can be any desired device for actuating roller 68 between the engaged state and the disengaged state.

Lever 78 is disposed on clamp bracket 84. Clamp shaft 80 extends from lever 78 through motor bracket 86. Pulling lever 78 upwards causes clamp shaft 80 to shift upwards and pull motor bracket 86 upwards, shifting motor bracket 86 to the disengaged position. One end of motor bracket 86 pivots around pivot point P2 as clamp shaft 80 pulls the other end of motor bracket 86 upwards. In one example, pivot point P2 is formed by a pin extending through motor bracket 86 and clamp bracket 84. But it is understood that pivot point P2 can be formed by any suitable device for loading roller 68 on beam 24 when in the engaged position, and spacing roller 68 from beam when in the disengaged position.

In the engaged position, shown in FIG. 4A, carriage clamp 60 exerts a downward force on motor bracket 86. Roller 68 extends though roller opening 88 in transverse plate 82 to engage beam 24. The downward force is transmitted to roller 68 through motor bracket 86, carriage motor 50, and output shaft 76. As such, the force generated by carriage clamp 60 exerts a load on roller 68 to facilitate engagement between roller 68 and beam 24. The load operationally locks roller 68 on beam 24 such that only rotation of roller 68 by carriage motor 50 can move carriage 28, dispense arm 26, and dispense outlets 48 (FIGS. 1A-1C) relative to beam 24.

In the disengaged position, shown in FIG. 4B, roller 68 is disengaged from beam 24 and carriage 28 is unlocked. In the disengaged position, guide wheels 64 provide the only interface between carriage 28 and beam 24 and facilitate lateral translation of carriage 28 along beam 24. As such, with roller 68 disengaged from beam 24, carriage 28 is free to move, and be moved, along the length of beam 24 without the locking, controlled movement effects of roller 68 on beam 24. As such, carriage 28 can be pushed laterally along beam 24 to any desired location along beam 24 to position dispense arm 26. With carriage 28 in the desired location on beam 24, carriage clamp 60 can be actuated to the locked position to reengage roller 68 with beam 24 and lock the position of carriage 28 on beam 24.

During operation, carriage 28 is positioned at a desired location on beam 24 and carriage clamp 60 is toggled to the locked position, thereby placing roller 68 in the engaged position shown in FIG. 4A. As discussed above, gearing 74 prevents force feedback to carriage motor 50 from roller 68, such that roller 68 locks carriage 28 at the desired location on beam 24. With roller 68 in the engaged state, roller 68 controls lateral movement of carriage 28 along beam 24.

The user monitors the position of dispense arm 26 and can cause carriage 28 to shift laterally along beam 24 to change the relative position of dispense arm 26 and control the application of the marking material to the ground surface. The user activates carriage motor 50 to cause lateral displacement of carriage 28. Carriage motor 50 drives roller 68 in either a clockwise or counterclockwise manner, depending on the input from the user. The translational force between roller 68 and beam 24 causes roller 68 to roll along beam 24 and carry carriage 28 laterally along beam 24. The connection between carriage 28 and dispense arm 26 causes dispense arm 26 to shift laterally along beam 24. When dispense arm 26 is in the desired location, the user deactivates carriage motor 50, and carriage motor 50 stops driving roller 68. Roller 68 remains engaged with beam 24 and locks carriage 28 in the new location on beam 24. As such, dispense arm 26 is locked in the desired lateral position for spraying.

Carriage 28 provides significant advantages. Carriage motor 50 is mounted on motor bracket 86, which is supported by transverse plate 82. As such, carriage motor 50 rides on carriage 28 as carriage 28 moves laterally along beam 24. Having carriage motor 50 ride on carriage 28 provides direct drive to roller 68, reducing the number and complexity of components controlling the lateral position of dispense arm 26. In addition, roller 68 directly interfaces with beam 24 and maintains the position of carriage 28 on beam 24. Having roller 68 fix the position of carriage 28 on beam 24 ensures that dispense arm 26 does not unexpectedly shift during operation and allows the user to precisely control the position of carriage 28 on beam 24.

In some examples, roller 68 is formed at least partially of a compliant material, such an elastomer, which further increases the useful life and precision placement of carriage. Roller 68 being formed from elastomer allows roller 68 to lock at any position along beam 24, without regard to the position of teeth and without regard to backlash that can be experienced in a rack-and-piston style design. In addition, the load generated by carriage clamp 60 on motor bracket 86 can be increased as roller 68 experiences compression set or wear. Increasing the load increases the useful life of roller 68, as the same frictional coefficient will be maintained between roller 68 and beam 24 even as roller 68 ages.

Figure 5:
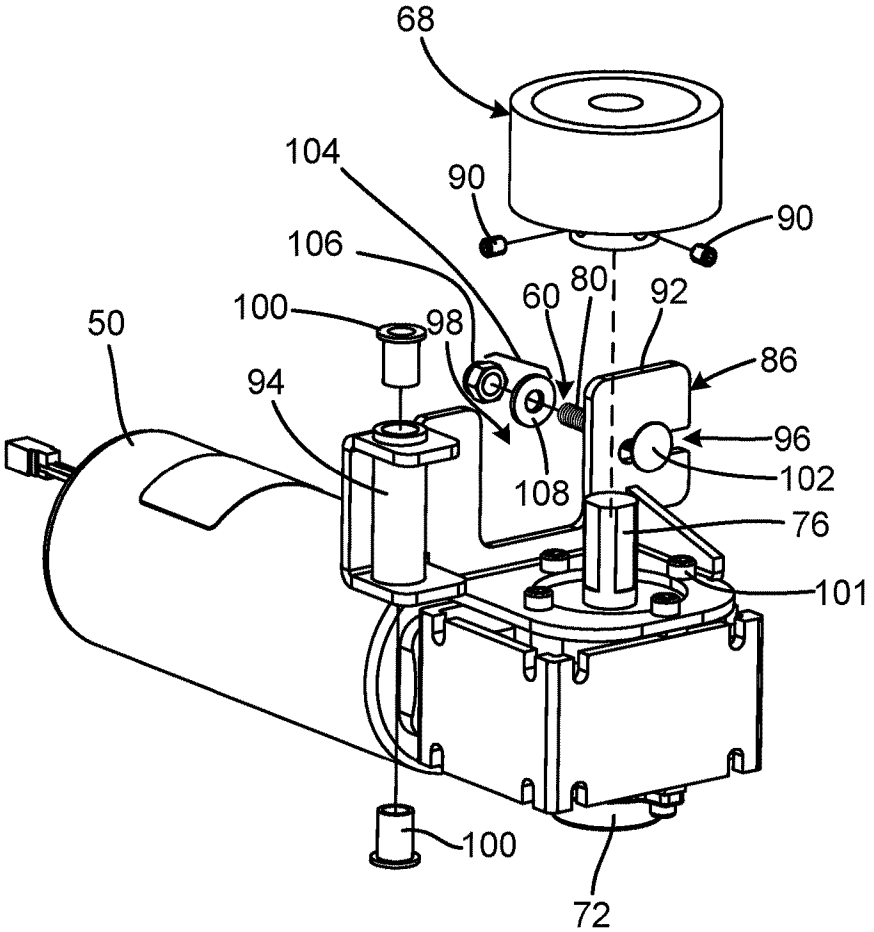
FIG. 5 is a partially exploded view of a drive assembly.

FIG. 5 is a partially exploded view showing carriage motor 50, carriage clamp 60, roller 68, motor bracket 86, and set screws 90. Gearbox 72 and output shaft 76 of carriage motor 50 are shown. Motor bracket 86 includes horizontal plate 92, tube 94, slot 96, roller opening 98, and bushings 100. Clamp shaft 80 of carriage clamp 60 is shown. Clamp shaft 80 includes head 102 and positioner 104. Positioner 104 includes nut 106 and washer 108.

Carriage motor 50 is supported by motor bracket 86. Gearbox 72 is attached to motor bracket 86 by fasteners 101 extending through motor bracket 86 into a housing of gearbox 72. Output shaft 76 extends from the gearing in gearbox 72 and is configured to be rotatably driven by carriage motor 50. Roller 68 is mounted on output shaft 76. Set screws 90 extend through a portion of roller 68 and engage output shaft 76. Set screws 90 secure roller 68 to output shaft 76.

Horizontal plate 92 is disposed above roller 68. Roller opening 98 is cut into horizontal plate 92. Roller opening 98 allows the circumferential edge of roller 68 to project through horizontal plate 92 when roller 68 is in the engaged position (shown in FIG. 4A). Bushings 100 extend into tube 94 disposed at a first end of horizontal plate 92. Bushings 100 are configured to receive a fastener, such as bolt 124 (FIG. 6), and facilitate rotation of motor bracket 86 on the fastener to form pivot point P2 (shown in FIGS. 4A-4B).

Slot 96 extends into an end of horizontal plate 92 opposite tube 94. While slot 96 is shown as open-ended, it is understood that slot 96 can be closed so long as slot 96 is sufficiently wide to allow clamp shaft 80 to move within slot 96 as motor bracket 86 pivots between the engaged position and the disengaged position. Clamp shaft 80 of carriage clamp 60 is disposed in slot 96. Head 102 is disposed on a bottom side of slot 96, and shaft projects through slot 96 to lever 78 (best seen in FIG. 6). The diameter of head 102 is larger than the width of slot 96, such that head 102 cannot pass through slot 96. Washer 108 and nut 106 are disposed on clamp shaft 80. Washer 108 and nut 106 secure clamp shaft 80 within slot 96, and can be positioned at any desired distance away from horizontal plate 92 to facilitate the pivoting of motor bracket 86.

Figure 6:
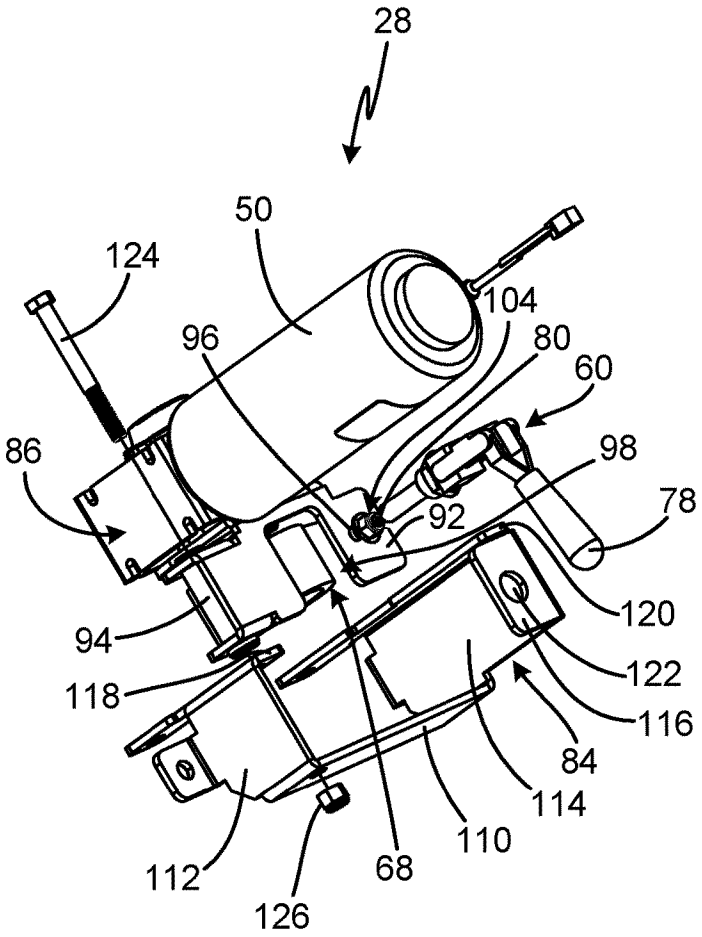
FIG. 6 is a partially exploded view of a drive assembly.

FIG. 6 is an exploded view of carriage 28. Carriage motor 50, carriage clamp 60, roller 68, clamp bracket 84, and motor bracket 86 of carriage 28 are shown. Motor bracket 86 includes horizontal plate 92, tube 94, slot 96, and roller opening 98. Lever 78, clamp shaft 80, and positioner 104 of carriage clamp 60 are shown. Clamp bracket 84 includes front 110, first lateral side 112, second lateral side 114, clamp flange 116, first lateral flange 118, and second lateral flange 120. Clamp flange 116 includes clamp opening 122. Bolt 124 and pivot nut 126 form pivot point P2 (shown in FIGS. 4A-4B).

Carriage motor 50 is supported by motor bracket 86. Roller 68 is operatively attached to and driven by carriage motor 50. Horizontal plate 92 is disposed above roller 68, and a portion of roller projects through roller opening 98 in horizontal plate 92. Tube 94 is disposed at a first end of horizontal plate 92, and slot 96 is disposed at a second end of horizontal plate 92.

Motor bracket 86 is connected to clamp bracket 84 by bolt 124 extending through tube 94. With motor bracket 86 attached to clamp bracket 84, roller 68 is disposed between first lateral side 112 and second lateral side 114 of clamp bracket 84. Front 110 of clamp bracket 84 extends between first lateral side 112 and second lateral side 114 and further encloses roller 68. Bolt 124 extends though first lateral flange 118 of clamp bracket 84, through tube 94, and through front 110 of clamp bracket 84. Pivot nut 126 is connected to an end of bolt 124 extending through front 110. Motor bracket 86 is configured to rotate on bolt 124 between the engaged position (FIG. 4A) and the disengaged position (FIG. 4B).

Second lateral side 114 of clamp bracket 84 projects above front 110 of clamp bracket 84. Clamp flange 116 extends from second lateral side 114 towards first lateral side 112. Clamp opening 122 extends through clamp flange 116.

Clamp shaft 80 extends through slot 96 and is operably connected to lever 78. Lever 78 is positioned on a top side of clamp flange 116, and clamp shaft 80 extends through clamp opening 122 to connect to lever 78. Lever 78 is configured to toggle between a locked position, where roller 68 is engaged with beam 24 (best seen in FIGS. 4A-4B), and an unlocked position, where roller 68 is disengaged from beam 24. While the two positions are described as "locked" and "unlocked," it is understood that lever 78 can maintain itself in the unlocked position, to maintain roller 68 in a disengaged state. As such, lever 78 can be secured in the "unlocked" position. In the example shown, to transition to the disengaged state, lever 78 is toggled to a vertical position, which pulls clamp shaft 80 upwards and causes clamp shaft 80 to pull motor bracket 86 upwards. Motor bracket 86 pivots on pivot point P2, pulling roller 68 upwards and disengaging roller 68 from beam 24.

Positioner 104 allows the user to control the load applied to roller 68 by carriage clamp 28. Positioner 104 can be threaded higher on clamp shaft 80 to reduce the load applied to roller 68, and can be threaded lower on clamp shaft 80 to increase the load applied to roller 68. As such, the user can adjust the load applied to roller 68 to adjust the coefficient of friction between roller 68 and beam 24. This provides particular advantages to increase the useful life of roller 68, as the user can counter compression set and wear experienced by roller 68 as roller 68 ages by readjusting positioner 104 on clamp shaft 80 to increase the load applied to roller 68.

Figure 7:
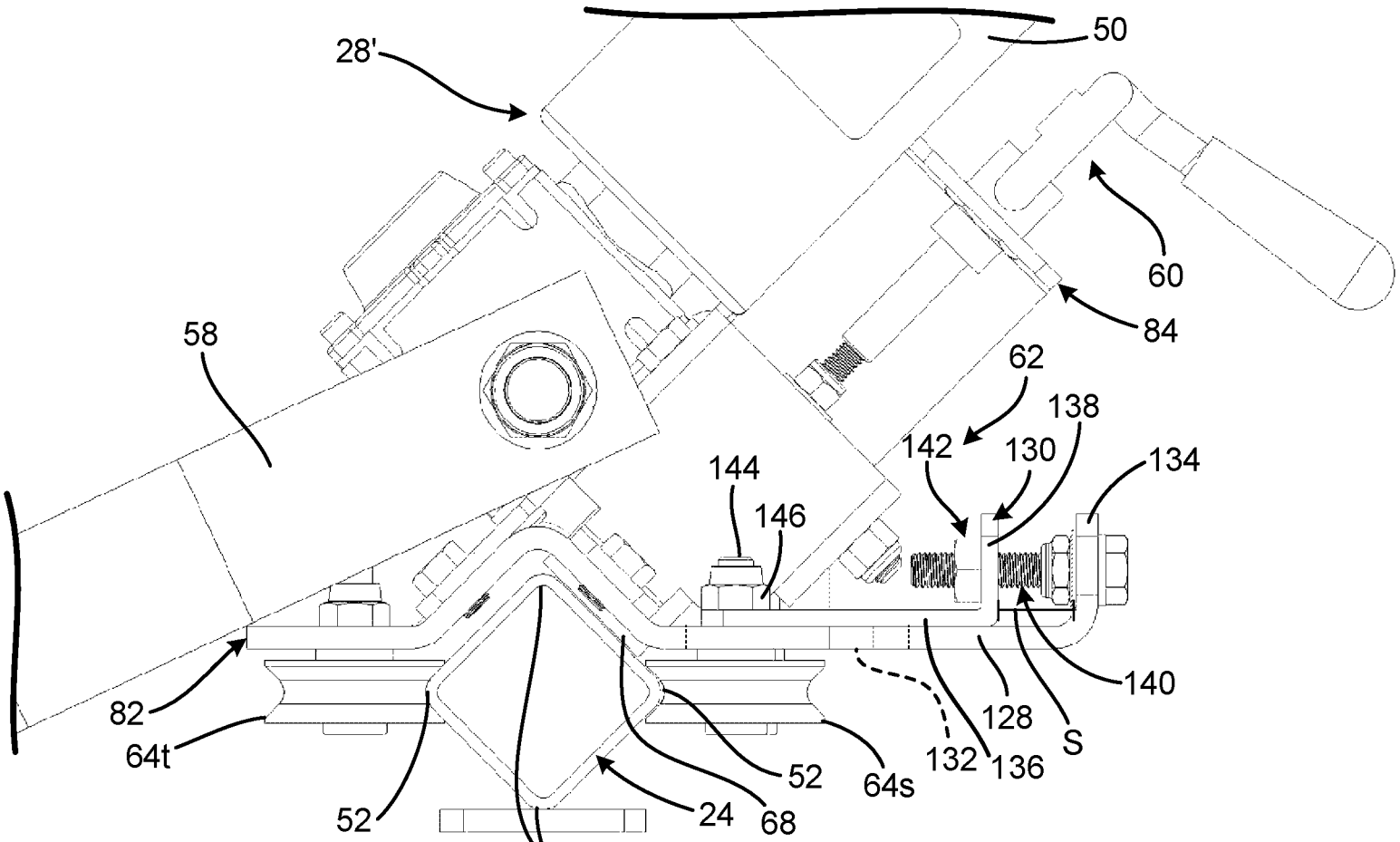
FIG. 7 is a side elevation view of a carriage.

FIG. 7 is a side cross-sectional view showing beam 24, carriage 28', and fork 58. Carriage motor 50, carriage clamp 60, carriage bracket 62', guide wheels 64*t*, 64*s*, and roller 68 of carriage 28 are shown. Beam 24 includes horizontal corners 52 and vertical corners 54. Clamp bracket 84 and transverse plate 82' of carriage bracket 62 are shown. Transverse plate 82' includes main plate 128 and sliding plate 130. Main plate 128 includes slot 132 and end flange 134. Sliding plate 130 includes horizontal portion 136, vertical portion 138, adjustment bolt 140, and slider nut 142. Guide wheel 64*s* includes wheel bolt 144 and wheel nut 146.

Carriage 28' supports dispense arm 26 (best seen in FIGS. 1A-1C) on beam 24. Fork 58 of dispense arm 26 is attached to transverse plate 82'. Transverse plate 82' extends across beam 24 and supports other components of carriage 28'. Carriage motor 50 is supported by carriage 28' and rides on carriage 28' as carriage traverses along beam 24. Roller 68 is operably connected to and driven by carriage motor 50. Roller 68 is configured to interface with beam 24 and to drive carriage laterally along beam 24. Clamp bracket 84 is supported by transverse plate 82. Carriage clamp 60 is disposed on clamp bracket 84 and is configured to actuate roller 68 between an engaged state, where roller 68 is loaded on beam 24, and a disengaged state, where roller 68 is spaced from beam 24.

Main plate 128 of transverse plate 82 extends substantially in the X-Y plane. End flange 134 extends vertically from a distal end of main plate 128. Slot 132 extends through main plate 128 and is elongate along the X-axis. Sliding plate 130 is disposed on a top side of main plate 128 and is configured to slide along the X-axis relative to main plate 128. Horizontal portion 136 is disposed on top of main plate 128 and vertical portion 138 extends vertically from horizontal portion 136. Slider nut 142 extends from vertical portion 138. In some examples, slider nut 142 is integrally formed with vertical portion 138.

Adjustment bolt 140 extends through an aperture (not shown) in end flange 134. Adjustment bolt 140 extends through vertical portion 138 of sliding plate 130 and through slider nut 142. In some examples, adjustment bolt 140 and slider nut 142 include interfaced threading to facilitate the connection between adjustment bolt 140 and slider nut 142. As such, rotating adjustment bolt 140 causes sliding plate 130 to move towards or away from beam 24 along the X-axis.

Guide wheels 64*t*, 64*s* extend from transverse plate 82' and engage horizontal corners 52 of beam 24. Guide wheel 64*t* is a static wheel disposed on a first side of beam 24, and guide wheel 64*s* is a sliding wheel disposed on a second side of beam 24. Guide wheel 64*t* is described as a static wheel because guide wheel 64*t* is prevented from moving relative to transverse plate 82 in the X-Y plane. Guide wheel 64*s* is directly connected to sliding plate 130 by wheel bolt 144 and wheel nut 146. Wheel bolt 144 extends through slot 132 in main plate 128 and through horizontal portion of sliding plate 130. Wheel nut 146 is attached to wheel bolt 144 and is configured to secure guide wheel 64*s* relative to beam 24.

During operation, slot 132 allows the position guide wheel 64*s* to be adjusted forward-backward along the X-axis. Adjusting the position of guide wheels 64*s* to be moved closer to or further away from beam 24. For example, the user can loosen wheel nut 146 on wheel bolt 144. With wheel nut 146 loosened, the user can rotate adjustment bolt 140. Rotating adjustment bolt 140 changes the separation S between vertical portion 138 of sliding plate 130 and end flange 134 of main plate 128. Reducing the separation S pulls guide wheels 64*s* away from beam 24, thereby increasing a separation between guide wheels 64*s* and horizontal corner 52. This allows for simple uninstallation of carriage 28 on beam 24. The user simply rotates adjustment bolt 140 to increase the separation between guide wheels 64*s* and beam 24 until the separation is large enough that carriage 28 can be lifted off of beam 24.

The user can also increase the separation S between vertical portion 138 of sliding plate 130 and end flange 134 of main plate 128 to engage guide wheels 64*s* on beam 24 and increase the compression of guide wheels 64*t* and 64*s* on beam 24. The user rotates the adjustment bolt 140 in the direction that increases separation S between vertical portion 138 and end flange 134. As separation S increases, sliding plate 130 moves along the X-axis, and guide wheel 64*s* is carried towards beam 24. Once guide wheels 64*s* engage beam 24, adjustment bolt 140 can continue to be rotated to increase the compression between guide wheels 64*t*, 64*s* and beam 24. When guide wheels 64*s* are in the desired position relative to transverse plate 82 and beam 24, the user can tighten wheel nut 146 on wheel bolt 144 to secure guide wheels 64*s* in the desired location. Increasing the compression provides a better grip between guide wheels 64*t*, 64*s* and beam 24, thereby providing smoother movement of carriage 28 along beam 24.

In some examples, two guide wheels 64*t* and two guide wheels 64*s* on each side of beam 24. It is understood, that a single sliding plate 130 can be connected to multiple guide wheels 64*s* to adjust the position of the multiple guide wheels 64*s*. A single adjustment bolt 140 can connect to sliding plate 130 and be used to adjust the position of the multiple guide wheels 64*s*. Having two guide wheels 64*s* automatically balances the forces between the guide wheels 64*s* and beam 24 when a single adjustment bolt 140 is used. Moreover, while guide wheels 64*s* are shown as adjustable and guide wheels 64*t* are shown as static, it is understood that all guide wheels 64*s*, 64*t* can be adjustable relative to transverse plate 82 and/or guide wheels 64*s* can be held static while guide wheels 64*t* can be adjustable.

Figure 8:
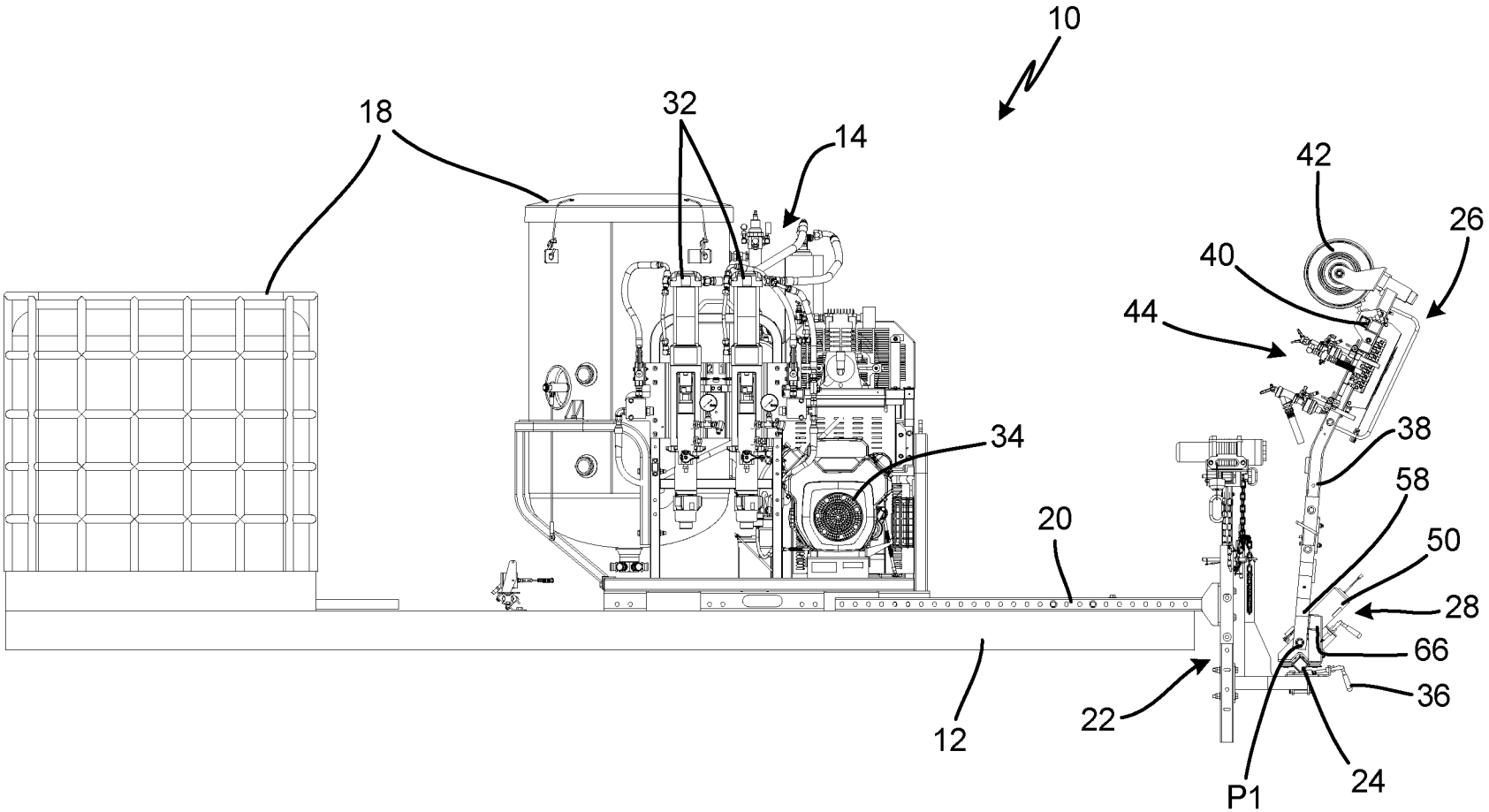
FIG. 8 is a side elevation view of a striping system showing a dispense arm in a transport position.

FIG. 8 is a side elevation view of striping system 10 showing dispense arm 26 in a stowed position. Vehicle surface 12, pumping module 14, fluid reservoirs 18, support frame 20, beam mount 22, beam 24, dispense arm 26, and carriage 28 of striping system 10 are shown. Pumping module 14 includes pumps 32 and motor 34. Beam mount 22 includes beam clamps 36. Dispense arm 26 includes boom 38, lateral arm 40, wheels 42, and dispensing modules 44. Boom 38 includes fork 58. Carriage motor 50 and stop 66 of carriage 28 are shown.

Dispense arm 26 is supported on the ground surface by wheels 42, and is connected to beam 24 by carriage 28. Fork 58 is mounted on carriage 28, and boom 38 extends from fork 58. Fork 58 is connected to carriage 28 at pivot point P1. As discussed above, carriage 28 is configured to control lateral movement of dispense arm 26, thereby controlling the lateral position of dispensing modules 44.

Dispense arm 26 is rotatable between a deployed position, shown in FIGS. 1A-1C, and the stowed position shown in FIG. 8. To transition dispense arm 26 to the stowed position, the user pushes dispense arm 26 upwards until fork 58 contacts stop 66. Fork 58 rests against stop 66, and stop 66 prevents dispense arm 26 from overrotating about pivot point P1. Dispense arm 26 can be locked in the stowed position in any desired manner. As discussed above, dispense arm 26 is laterally locked on beam 24 by roller 68 (best seen in FIGS. 3-4B) when roller 68 is in the engaged position. As such, carriage 28 prevents lateral movement of dispense arm 26 along beam 24 regardless of if dispense arm 26 is deployed or stowed.

Dispense arm 26 is usually transitioned to the stowed position for transport or during storage. In some examples, dispense arm 26 is placed in the stowed position and transitioned to the other side of vehicle to facilitate marking on that side of the vehicle. For example, the user can activate carriage motor 50, and carriage 28 can drive itself along beam 24 to change the position of dispense arm 26 from one side of the vehicle to the other. In another example, the user can place carriage in the disengaged state and then push dispense arm 26 and carriage 28 along beam 24 to the desired position.

Figure 9:
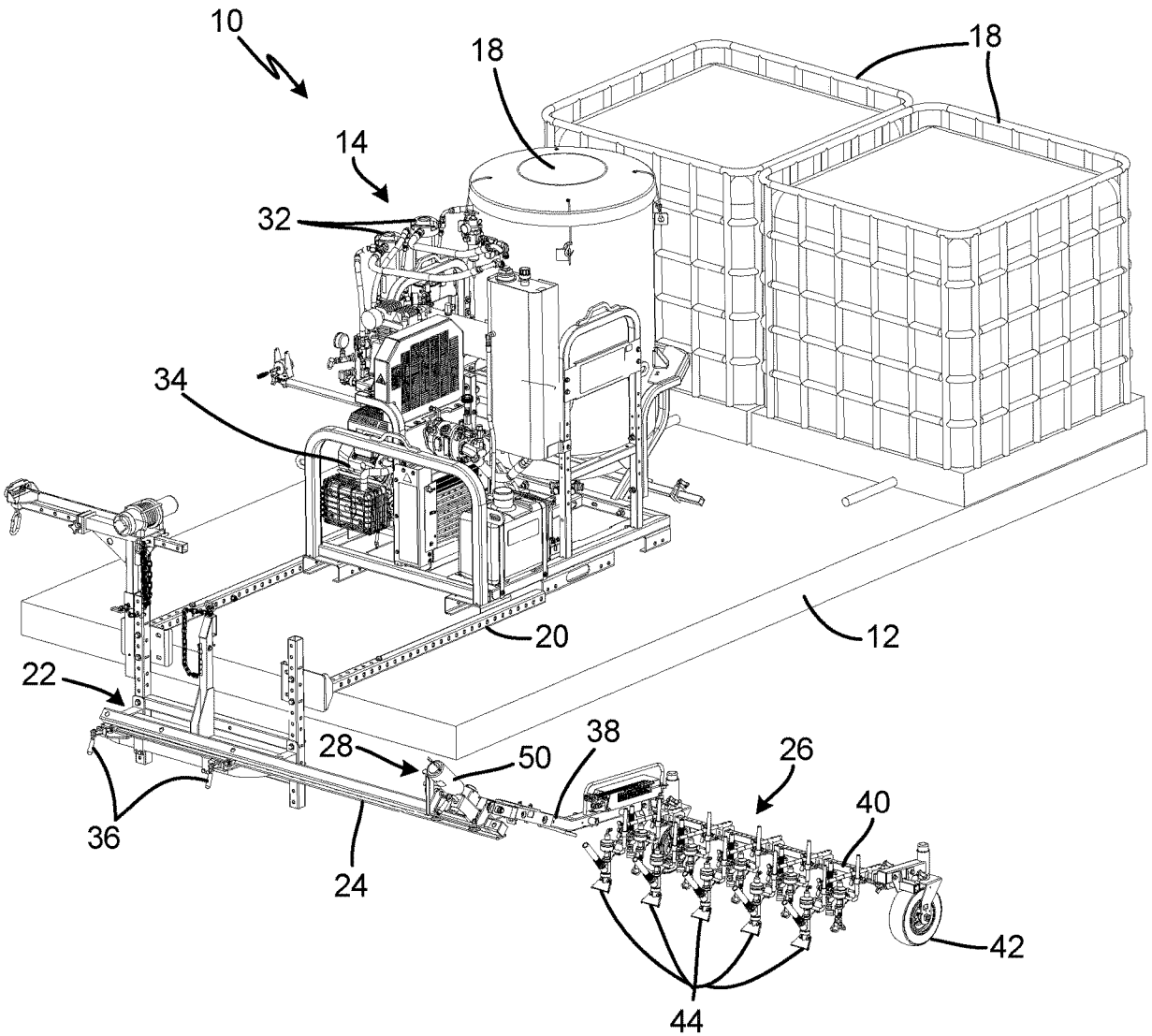
FIG. 9 is an isometric view of a striping system.

FIG. 9 is an isometric view of striping system 10 showing dispense arm 26 on a passenger side of the vehicle. Vehicle surface 12, pumping module 14, fluid reservoirs 18, support frame 20, beam mount 22, beam 24, dispense arm 26, and carriage 28 of striping system 10 are shown. Pumping module 14 includes pumps 32 and motor 34. Beam mount 22 includes beam clamps 36. Dispense arm 26 includes boom 38, lateral arm 40, wheels 42, and dispensing modules 44. Carriage motor 50 of carriage 28 is shown.

Dispense arm 26 can be positioned to apply stripes on the passenger side of the vehicle. Typically, beam 24 is of a limited width, such that beam 24 extends laterally from a single side of the vehicle. A longer beam 24 may be unwieldy and make maneuvering of the vehicle difficult, and some jurisdictions have limits on vehicle width that longer beams may violate. As such, beam 24 can be shifted laterally relative to vehicle surface 12 to adjust the side of the vehicle that beam 24 extends from. The user can adjust the position of beam 24 by toggling beam clamps 36 to unlock beam 24 from beam mount 22, and then sliding beam 24 laterally along the Y-axis. Beam 24 is secured in the desired position by toggling beam clamps 36 to lock beam 24 to beam mount 22.

With beam 24 in the desired position and dispense arm 26 in the stowed position, carriage 28 is laterally displaced along beam 24 to position dispense arm 26 at the desired location. Carriage 28 can be laterally displaced by roller 68 (best seen in FIGS. 4A-4B) being in the engaged position and driving carriage 28 along beam 24, or by roller 68 being in the disengaged position and the user pushing carriage 28 along beam 24. With dispense arm 26 in the desired location, dispense arm 26 is rotated back to the deployed position and is ready to apply stripes on the passenger side of the vehicle. It is understood that the user may adjust lateral arm 40 relative to boom 38 to properly position dispensing modules 44.

With carriage motor 50 mounted on carriage 28, carriage 28 can move dispense arm 26 along beam 24 whether dispense arm 26 is in the stowed position or the deployed position. Carriage 28 can be moved to any desired position on beam 24 regardless of the relative position of the vehicle.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A ground marking apparatus for mounting on a vehicle, the apparatus comprising:

a beam mount;

a beam supported by the beam mount and extending along a beam axis;

a carriage disposed on the beam and movable on the beam along the beam axis, the carriage including:

a carriage bracket extending over the beam; and a plurality of wheels supported by the carriage bracket and engaging the beam, the plurality of wheels configured to roll along the beam;

a carriage motor mounted on the carriage bracket such that the carriage motor moves with the carriage relative to the beam;

a roller operably connected to the carriage motor such that the carriage motor drives rotation of the roller; and a dispense arm supported by the carriage, the dispense arm including at least one dispense outlet configured to eject marking material onto a ground surface;

wherein the roller is actuatable between an engaged position, where the roller is engaged with the beam to drive the carriage relative to the beam, and a disengaged position, where the roller is disengaged from the beam such that the carriage motor is prevented from moving the carriage relative to the beam; and wherein the carriage motor and the roller are connected such that the carriage motor moves with the roller as the roller is actuated away from the beam and between the engaged position and the disengaged position.

2. The ground marking apparatus of claim 1, wherein the beam extends laterally relative to the vehicle with respect to the principal forward direction of movement of the vehicle.

3. The ground marking apparatus of claim 1, further comprising:

a beam clamp connecting the beam to the beam mount.

4. The ground marking apparatus of claim 1, wherein the roller is at least partially formed from an elastomer.

5. The ground marking apparatus of claim 1, wherein the roller is configured to engage a flat surface of the beam, such that the roller moves the carriage relative to the beam due to translational forces generated by a frictional interface between the roller and the flat surface of the beam.

6. The ground marking apparatus of claim 1, further comprising:

a carriage clamp disposed on the carriage, the carriage clamp actuatable between a locked state, where the carriage clamp holds the roller on the beam, and an unlocked state, where the roller is disengaged from the beam.

7. The ground marking apparatus of claim 6, wherein:

the carriage bracket comprises:

a transverse plate extending over the beam; and a motor bracket pivotably mounted to the transverse plate, the motor bracket configured to pivot between an engaged position and a disengaged position;

wherein the carriage motor is supported by the motor bracket; and wherein the carriage clamp is configured to hold the motor bracket in the engaged position when the carriage clamp is in the locked state, and to hold the motor bracket in the disengaged position when the carriage clamp is in the unlocked state.

8. The ground marking apparatus of claim 6, wherein the carriage clamp is configured to disengage the roller from the beam by pivoting the roller away from the beam.

9. The ground marking apparatus of claim 6, wherein the carriage motor locks a position of the roller on the beam when the carriage clamp is in the locked state and the motor is deactivated, such that the carriage motor prevents the carriage from moving relative to the beam with the carriage motor deactivated and the carriage clamp in the locked state.

10. The ground marking apparatus of claim 6, wherein the carriage clamp comprises an overcenter clamp having a lever configured to toggle between the engaged state and the disengaged state.

11. The ground marking apparatus of claim 1, wherein:

the dispense arm includes at least one wheel configured to roll along the ground surface and support the dispense arm relative to the ground surface;

the dispense arm is pivotably connected to the carriage, such that the dispense arm can be pivoted between a deployed position, where the dispense arm extends generally longitudinally from the carriage, and a stowed position, where the dispense arm extends generally vertically from the carriage; and the carriage can move along the beam and transition the dispense arm, while the dispense arm is in the stowed position, from being disposed on a first lateral side of the vehicle to being disposed on a second lateral side of the vehicle.

12. A striping system for applying a marking material to a ground surface, the striping system comprising:

a fluid reservoir configured to store marking material;

a support frame configured to be mounted on a vehicle;

the ground marking apparatus of claim 1, wherein the beam mount is connected to the support frame; and a pumping module supported by the support frame and configured to pump marking material from the fluid reservoir to the at least one dispense outlet.

13. A ground marking apparatus for mounting on a vehicle, the apparatus comprising:

a beam mount;

a beam supported by the beam mount and extending along a beam axis;

a carriage disposed on the beam and movable on the beam along the beam axis, the carriage comprising:

a carriage bracket extending over the beam; and a plurality of wheels supported by the carriage bracket and engaging the beam, the plurality of wheels configured to roll along the beam;

a carriage motor operably interfacing with the beam and configured to move the carriage along the beam;

a dispense arm supported by the carriage, the dispense arm including at least one dispense outlet configured to eject marking material onto a ground surface;

wherein the carriage bracket includes a transverse plate extending over the beam;

wherein the plurality of wheels are attached to the transverse plate;

wherein the beam has a square cross sectional profile with vertical corners and horizontal corners;

wherein a first one of the plurality of wheels is disposed on a first side of the beam and configured to engage a first one of the horizontal corners; and wherein a second one of the plurality of wheels is disposed on a second side of the beam and configured to engage a second one of the horizontal corners.

14. The ground marking apparatus of claim 13, further comprising:

a sliding plate disposed on an opposite side of the transverse plate from the second one of the plurality of wheels;

a bolt extending through the transverse plate and into the sliding plate;

wherein the sliding plate is configured to slide relative to the transverse plate;

wherein rotation of the bolt causes the sliding plate to move relative to the transverse plate; and wherein the second one of the plurality of wheels is connected to the sliding plate such that movement of the sliding plate relative to the transverse plate in a first direction moves the second one of the plurality of wheels closer to the beam and movement in a second direction moves the second of the plurality of wheels further from the beam.

15. A ground marking apparatus for mounting on a vehicle, the apparatus comprising:

a beam mount;

a beam supported by the beam mount and extending along a beam axis;

a carriage disposed on the beam and movable on the beam along the beam axis, the carriage comprising:

a carriage bracket extending over the beam; and a plurality of wheels supported by the carriage bracket and engaging the beam, the plurality of wheels configured to roll along the beam;

a carriage motor mounted on the carriage bracket such that the carriage motor moves with the carriage relative to the beam;

a roller operably connected to the carriage motor such that the carriage motor drives rotation of the roller, wherein the roller engages the beam and is configured to drive movement of the carriage relative to the beam;

a dispense arm supported by the carriage, the dispense arm including at least one dispense outlet configured to eject marking material onto a ground surface;

wherein the carriage motor is an electric motor and includes a drive shaft configured to drive rotation of gearing;

wherein the drive shaft includes a worm; and wherein the gearing includes worm wheels and is configured to drive rotation of an output shaft on which the roller is mounted.

16. The ground marking apparatus of claim 15, further comprising:

a user interface operatively connected to the carriage motor;

wherein the drive shaft is configured to rotate clockwise based on a first input to the carriage motor from the user interface; and wherein the drive shaft is configured to rotate counterclockwise based on a second input to the carriage motor from the user interface.

* * * * *